US010914489B2

(12) United States Patent
Nogami et al.

(10) Patent No.: US 10,914,489 B2
(45) Date of Patent: Feb. 9, 2021

(54) SHUTTER STRUCTURE

(71) Applicant: PANASONIC INTELLECTUAL PROPERTY MANAGEMENT CO., LTD., Osaka (JP)

(72) Inventors: Wakana Nogami, Osaka (JP); Yoshiya Shigenobu, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 62 days.

(21) Appl. No.: 15/709,064

(22) Filed: Sep. 19, 2017

(65) Prior Publication Data

US 2018/0087801 A1 Mar. 29, 2018

(30) Foreign Application Priority Data

Sep. 27, 2016 (JP) ..... 2016-187648

(51) Int. Cl.
*F24F 13/14* (2006.01)
*F24F 13/10* (2006.01)

(52) U.S. Cl.
CPC ..... *F24F 13/1426* (2013.01); *F24F 13/14* (2013.01); *F24F 2013/1466* (2013.01)

(58) Field of Classification Search
CPC ..... F24F 13/1406; F24F 13/1486; F24F 13/10–13/18
USPC ..... 454/259
See application file for complete search history.

(56) References Cited

U.S. PATENT DOCUMENTS 3,290,001 A * 12/1966 Taylor ..... F16K 1/226 251/175
4,327,869 A * 5/1982 Nawa ..... F24F 13/14 239/590.5
4,917,350 A * 4/1990 Beyer ..... F16K 1/222 251/129.11

(Continued)

FOREIGN PATENT DOCUMENTS

JP 2003-065581 A 3/2003
JP 2007-333221 A 12/2007

(Continued)

OTHER PUBLICATIONS

Partial Translation for JP02003065581A Knizhnik, Irina (Year: 2019).*

*Primary Examiner* — Edelmira Bosques
*Assistant Examiner* — Christopher Matthew Odell
(74) *Attorney, Agent, or Firm* — McDermott Will & Emery LLP

(57) ABSTRACT

A shutter structure includes a rotary shaft, a shutter plate, an upper rib and at least one lower rib. The rotary shaft is provided in a cylindrical duct line. The shutter plate rotates about the rotary shaft and switches between an open state and a closed state. The shutter plate has a peripheral edge portion, a curved portion, and a shutter plate shaft portion. The peripheral edge portion includes an upper shielding plate and two lower shielding plates. The lower shielding plates are located symmetrically to each other with respect to a center line. The center line is perpendicular to the shutter plate shaft portion. When the shutter plate is in the closed state, the upper shielding plate comes into contact with the upper rib from an upstream side, and the lower shielding plates come into contact with the at least one lower rib from a downstream side.

6 Claims, 7 Drawing Sheets

(56) References Cited

U.S. PATENT DOCUMENTS

| | | | | | |
|---|---|---|---|---|---|
| 5,673,895 | A * | 10/1997 | Kaneko | F16K 1/2268 | 251/305 |
| 9,052,131 | B2 * | 6/2015 | Reimann | F24F 13/10 | |
| 2013/0333784 | A1 * | 12/2013 | Marak | F16K 37/0016 | 137/601.17 |
| 2014/0206276 | A1 * | 7/2014 | Zhong | F24F 13/24 | 454/317 |
| 2015/0140923 | A1 * | 5/2015 | Penlesky | F24F 7/007 | 454/322 |
| 2016/0313024 | A1 * | 10/2016 | Grimaldi | F24F 13/10 | |

FOREIGN PATENT DOCUMENTS

| | | | | | |
|---|---|---|---|---|---|
| JP | 2009275993 | A * | 11/2009 | | |
| WO | WO-2007064270 | A1 * | 6/2007 | F24F 11/75 | |

* cited by examiner

FIG. 6 --PRIOR ART--
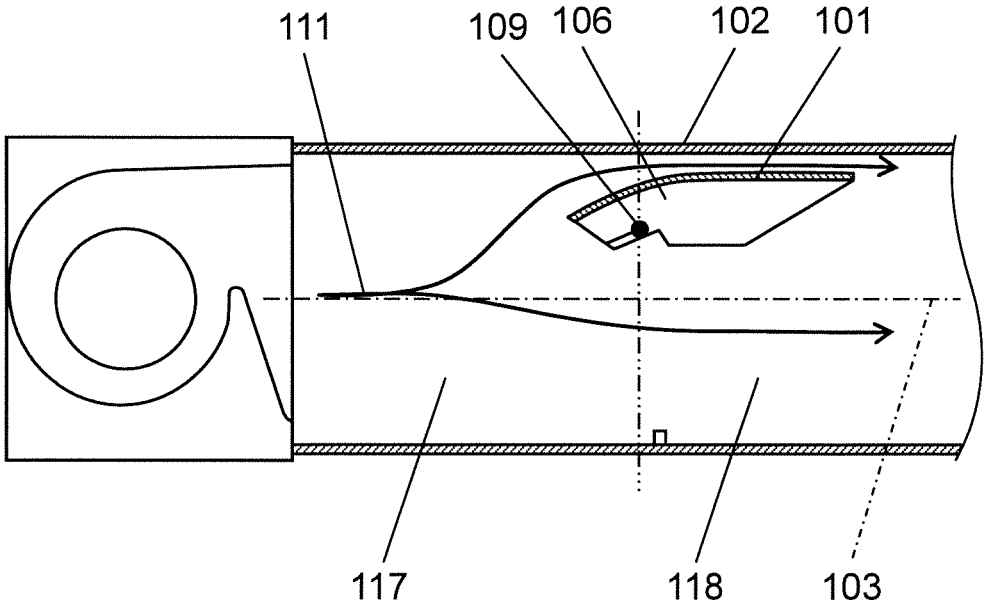

FIG. 7A --PRIOR ART--
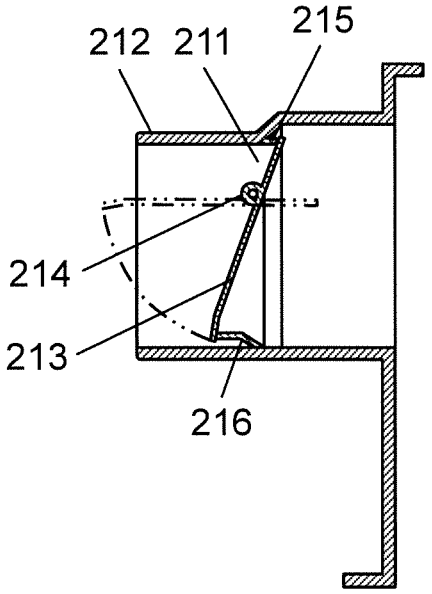
FIG. 7B --PRIOR ART--
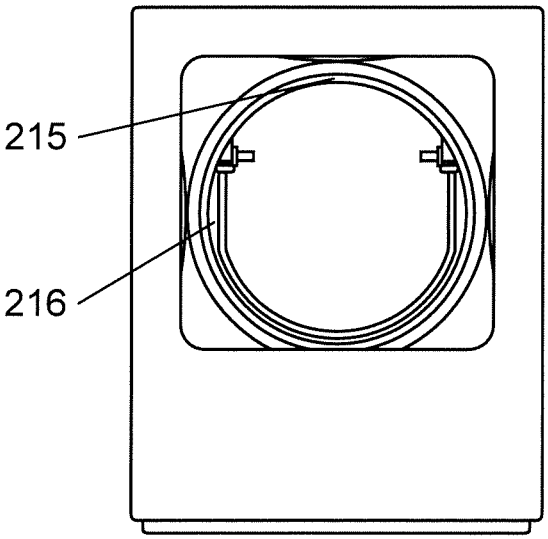

SHUTTER STRUCTURE

RELATED APPLICATIONS

This application claims the benefit of Japanese Application No. 2016-187648, filed on Sep. 27, 2016, the entire disclosure of which Application is incorporated by reference herein.

BACKGROUND

1. Technical Field

The present disclosure relates to a shutter structure.

2. Description of the Related Art

Conventionally, to achieve a shutter structure used for preventing fluid from reversely flowing into a duct line, there has been known a shutter plate having a cross-sectional shape smoothly formed by a plurality of circular arcs in a plane perpendicular to its rotary shaft (e.g., see Patent Literature 1).

Hereinafter, the shutter structure will be described with reference to FIG. 6.

FIG. 6 is a schematic cross sectional view showing a configuration of the conventional shutter structure. As shown in FIG. 6, shutter structure 101 is constituted by shutter plate 106 provided in duct line 102, and rotary shaft 109. Shutter plate 106 is pivotable about rotary shaft 109, and is rotated to open and close duct line 102. In the state where duct line 102 is opened, a portion located on an upstream side from rotary shaft 109 is defined as upstream region 117 based on a flow direction of airflow 111 on shutter plate 106. A portion located on a downstream side from rotary shaft 109 is defined as downstream region 118. In the state where duct line 102 is opened, for a cross-sectional shape of shutter plate 106 in any plane passing through duct line axis 103 entirely, a cross-sectional shape of upstream region 117 and a cross-sectional shape of downstream region 118 are smoothly connected by a circular arc or a plurality of circular arcs.

With the above configuration, fluid can smoothly be guided from upstream region 117 to downstream region 118 of shutter plate 106 in the state where duct line 102 is opened. This makes it possible to prevent flow disturbance of the fluid, thereby reducing ventilation resistance, or noise and vibration due to the flow disturbance.

Further, in this kind of shutter structure, a shield wall to be in contact with the shutter plate may be provided on a duct line side (e.g., see Patent Literature 2).

Hereinafter, the shutter structure will be described with reference to FIGS. 7A and 7B.

FIG. 7A is a partial schematic cross sectional view showing a configuration of the conventional shutter structure. FIG. 7B is a front view showing the configuration of the conventional shutter structure. As shown in FIGS. 7A and 7B, shutter structure 211 is constituted by shutter plate 213 provided in duct line 212, and rotary shaft 214. Shutter plate 213 is pivotable about rotary shaft 214, and is rotated to open and close duct line 212. Further, in duct line 212, upper shield wall 215 and lower shield wall 216 are provided. Upper shield wall 215 is disposed on an upper side from rotary shaft 214 and comes into contact with a periphery of shutter plate 213 on a front surface side when shutter plate 213 is closed. Lower shield wall 216 is disposed on a lower side from rotary shaft 214 and comes into contact with a periphery of shutter plate 213 on a back surface side when shutter plate 213 is closed.

With the above configuration, shutter plate 213 is brought into contact with upper shield wall 215 and lower shield wall 216 when shutter plate 213 is closed. Thus, rotation of shutter plate 213 due to external wind can be prevented, thereby inhibiting the external wind from flowing into a room.

CITATION LIST

Patent Literature

PTL 1: Unexamined Japanese Patent Publication No. 2007-333221

PTL 1: Unexamined Japanese Patent Publication No. 2003-065581

SUMMARY

In shutter structure 101 described in Patent Literature 1, shutter plate 106 has a cross-sectional shape in a plane passing through duct line axis 103 such that the cross-sectional shape of upstream region 117 and the cross-sectional shape of downstream region 118 are smoothly connected by a circular arc or a plurality of circular arcs in the state where shutter plate 106 is closed. Further, the cross-sectional shape is bulged to the downstream side of duct line 102. This makes it possible for shutter plate 106 to close duct line 102 when the external wind reversely flows from the downstream side of duct line 102. However, if the external wind flows along a surface of shutter plate 106, a gap between the periphery of shutter plate 106 and duct line 102 will be increased, so that the external wind is likely to flow into a blower module and an indoor room disadvantageously.

Further, in shutter structure 211 as described in Patent Literature 2, upper shield wall 215 and lower shield wall 216 function as ventilation resistance in duct line 212 in the state where shutter plate 213 is opened. Therefore, to ensure predetermined airflow, it is necessary to increase a load to a fan and a motor disadvantageously to increase its output.

To solve such conventional problems, the present disclosure aims to provide a shutter structure capable of preventing inflow of an external wind while controlling ventilation resistance.

In order to achieve the aim, the shutter structure in accordance with the present disclosure includes a rotary shaft provided in a cylindrical duct line through which fluid flows from an upstream side to a downstream side, a shutter plate that is rotated about the rotary shaft and disposed to switch between an open state in which the fluid flows into the duct line and a closed state in which the duct line is closed, and an upper rib and a lower rib provided on an inner wall of the duct line. The shutter plate has a peripheral edge portion constituted by an upper shielding plate and two lower shielding plates that are provided on the cross section thereof perpendicular to a central axis of the duct line in the closed state, a curved portion in which a center portion and a downstream side end of the shutter plate are bulged to the downstream side relative to the peripheral edge portion, and a shutter plate shaft portion that is located in the curved portion and pivotally supported by the rotary shaft. The lower shielding plates are located at positions symmetrical to each other with respect to a center line intersecting with the shutter plate shaft portion perpendicularly, and the upper shielding plate is located on the center line. When the shutter plate is in the closed state, the upper shielding plate comes into contact with an upper rib from the upstream side, and the lower shielding plates come into contact with a lower rib from the downstream side. Thus, the intended aim is achieved.

According to the present disclosure, when the shutter plate is rotated about the rotary shaft to open the duct line as airflow flows from the upstream side to the downstream side in the duct line, the upper rib and the lower ribs, which are disposed in the duct line, are small enough not to cause ventilation resistance. Thus, ventilation resistance in the opened state of the shutter plate is reduced. Further, when the airflow flows into the duct line from the downstream side to the upstream side, the shutter plate is rotated about the rotary shaft to close the duct line, thereby causing the upper shielding plate to come into contact with the upper rib, and causing the lower shielding plates to come into contact with the lower ribs. Thus, the airflow can advantageously be prevented from flowing into the inside through a gap between the shutter plate and the duct line.

Consequently, the present disclosure makes it possible to provide a shutter structure and a blower module that reduce ventilation resistance of a flow passage in the opened state and prevent inflow of external wind in the closed state more effectively.

BRIEF DESCRIPTION OF DRAWINGS

FIG. 6 is a schematic cross sectional view showing a configuration (configuration including a shutter plate with a cross-sectional shape formed by a plurality of circular arcs) of the conventional shutter structure;

FIG. 7A is a partial schematic cross sectional view showing a configuration (configuration including a shielding wall) of the conventional shutter structure; and FIG. 7B is a front view showing the configuration (configuration including a shielding wall) of the conventional shutter structure.

DETAILED DESCRIPTION

Figure 1A:
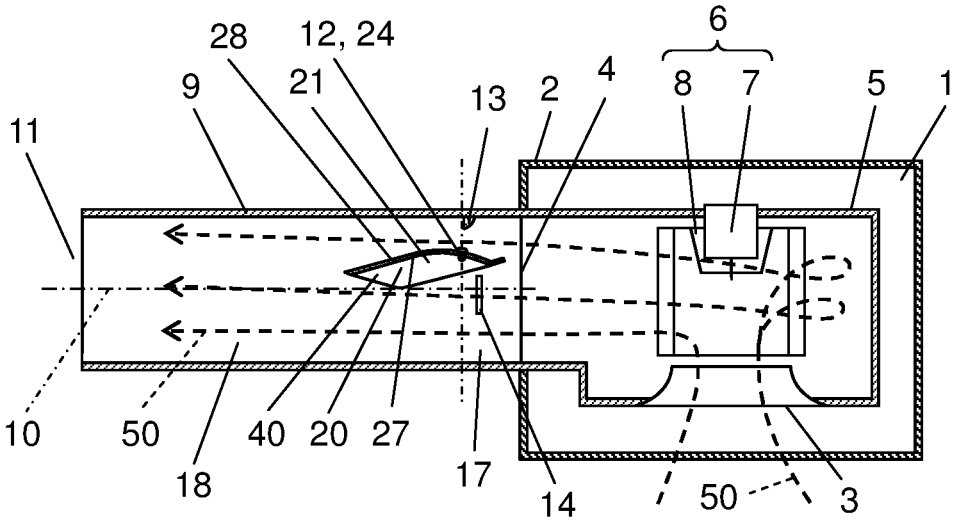
FIG. 1A is a schematic cross sectional view showing an open state of a shutter structure in an exemplary embodiment of the present disclosure.

The shutter structure in accordance with claim 1 of the present disclosure includes a rotary shaft provided in a cylindrical duct line through which fluid flows from an upstream side to a downstream side, a shutter plate that is rotated about the rotary shaft and disposed to switch between an open state in which fluid flows into the duct line and a closed state in which the duct line is closed, and an upper rib and a lower rib provided on an inner wall of the duct line. The shutter plate has a peripheral edge portion constituted by an upper shielding plate and two lower shielding plates that are provided on the cross section thereof perpendicular to a central axis of the duct line in the closed state, a curved portion in which a center portion and a downstream side end of the shutter plate are bulged to the downstream side relative to the peripheral edge portion, and a shutter plate shaft portion that is located in the curved portion and pivotally supported by the rotary shaft. The lower shielding plates are located at positions symmetrical to each other with respect to a center line intersecting with the shutter plate shaft portion perpendicularly, and the upper shielding plate is located on the center line. When the shutter plate is in the closed state, the upper shielding plate comes into contact with the upper rib from the upstream side, and the lower shielding plates come into contact with the lower rib from the downstream side. Thus, when the shutter plate is in the closed state, the upper rib and the lower ribs are also provided on the cross section.

Accordingly, when airflow flows into the duct line from the upstream side to the downstream side, the airflow is received by the entire upstream side surface (surface located on an upstream side of the duct line in the closed state) of the shutter plate. Thus, the shutter plate is rotated about the rotary shaft at a position where ventilation resistance and self-weight of the shutter plate are balance, and then turned into the open state. Further, when airflow does not flow from the upstream side to the downstream side in the duct line, the shutter plate is rotated about the rotary shaft by self-weight of the shutter plate and then turned into the closed state.

In other words, in the case where airflow flows into the duct line from the upstream side to the downstream side and turns the shutter plate into the open state, the ribs, i.e., the upper rib and the lower ribs disposed in the duct line can be made small enough not to cause ventilation resistance, because the upper rib and the lower ribs are only disposed in the duct line. As a result, the airflow is not disturbed significantly, and ventilation resistance is not affected.

Further, in the case where the shutter plate is in the closed state, even if airflow flows into the duct line from the downstream side to the upstream side, the airflow is received by the entire downstream side surface (surface located on a downstream side of the duct line in the closed state) of the shutter plate. In this case, the upper shielding plate of the shutter plate comes into contact with the upper rib from the upstream side in the duct line, and the lower shielding plates of the shutter plate come into contact with the lower ribs from the downstream side in the duct line. Thus, the shutter plate is fixed, and the airflow is guided to the upper shielding plate and the two lower shielding plates along a surface of the shutter plate, so that the airflow can be prevented from flowing into the inside through a gap between the shutter plate and the duct line by using the upper shielding plate portion and the upper rib, and the two lower shielding plates and the lower ribs.

Further, the shutter structure in accordance with claim 2 of the present disclosure is characterized by a flow passage in the duct line divided into an upstream region and a downstream region by a plane that is perpendicular to the central axis and includes the rotary shaft, and the curved portion is formed to be curved at least partially ranging from the upstream region side to the downstream region side along the central axis.

Accordingly, when airflow flows into the duct line from the upstream side to the downstream side, the airflow is received by the entire upstream side surface (surface located on the upstream side of the duct line in the closed state) of the shutter plate, which includes the curved portion and is formed to have a smoothed cross-sectional shape, and the shutter plate is rotated about the rotary shaft at a position where ventilation resistance and self-weight of the shutter plate are balanced, and then turned into the open state.

At this time, the airflow flows along the curved portion of the shutter plate. This prevents disturbance of the airflow, so that ventilation resistance can be reduced.

Further, the shutter structure in accordance with claim 3 of the present disclosure is characterized by the shutter plate being formed to be curved symmetrically to the center line.

Accordingly, even if airflow flows into the duct line from the downstream side to the upstream side in the closed state, the airflow is received by the entire downstream side surface (surface located on a downstream side of the duct line in the closed state) of the shutter plate that is curved symmetrically to the center line. This causes the upper shielding plate to come into contact with the upper rib from the upstream side in the duct line, and causes the lower shielding plates of the shutter plate to come into contact with the lower ribs from the downstream side in the duct line, so that the shutter plate is remained in the closed state.

At this time, the airflow flows toward the upper shielding plate and the two lower shielding plates along the downstream side surface of the shutter plate. This ensures the contact of the upper shielding plate and the upper rib, and the contact of the lower shielding plates and the lower ribs. Further, the airflow can be prevented from reversely flowing through a gap between the shutter plate and the duct line by using the upper shielding plate and the upper rib, and the two lower shielding plates and the lower ribs.

Further, the shutter structure in accordance with claim 4 of the present disclosure is characterized by the two lower shielding plates of the shutter plate being formed to face each other on a diameter of the duct line parallel to the rotary shaft in the closed state.

Accordingly, even if airflow flows into the duct line from the downstream side to the upstream side in the closed state, the airflow flows uniformly toward the lower shielding plates, which are formed to face each other on a diameter of the duct line parallel to the rotary shaft, along the downstream side surface of the shutter plate,. At this time, the contact of the two lower shielding plates and lower ribs is well balanced. In addition to the upper shielding plate and the upper rib, the two lower shielding plates and the lower ribs can prevent the airflow from reversely flowing into the inside through a gap between the shutter plate and the duct line.

Further, the shutter structure in accordance with claim 5 of the present disclosure is characterized by, in a cross section including the central axis, the downstream side end being located on the downstream side from a plane that is perpendicular to the central axis and includes the rotary shaft.

Accordingly, when the shutter plate transfers from the closed state to the open state, airflow is received by the entire upstream side surface of the shutter plate. After hitting the upstream side surface of the shutter plate, the airflow flows along the upstream side surface of the shutter plate and gathers at the downstream side end of the shutter plate.

At this time, the more acute an angel between an axis connecting the rotary shaft with the downstream side end of the shutter plate and the central axis of the duct line, the more easily a gap is generated between an outer periphery of the shutter plate and an inner wall of the duct line even if the shutter plate is rotated at a small angle. In other words, if the downstream side end is located on the downstream side from the plane that is perpendicular to the central axis of the duct line and includes the rotary shaft, a gap may easily be generated between an outer periphery of the shutter plate and an inner wall of the duct line by the minimum airflow. Thus, the shutter plate is easily opened and closed.

Hereinafter, an exemplary embodiment of the present disclosure will be described with reference to the drawings.

Note that, to avoid overlap, the same numerals are assigned to the same parts throughout the drawings, and the description is omitted after the second time.

Exemplary Embodiment

Hereinafter, a configuration in an exemplary embodiment of the present disclosure will be described in detail with reference to FIGS. 1A through 5.

Figure 1B:
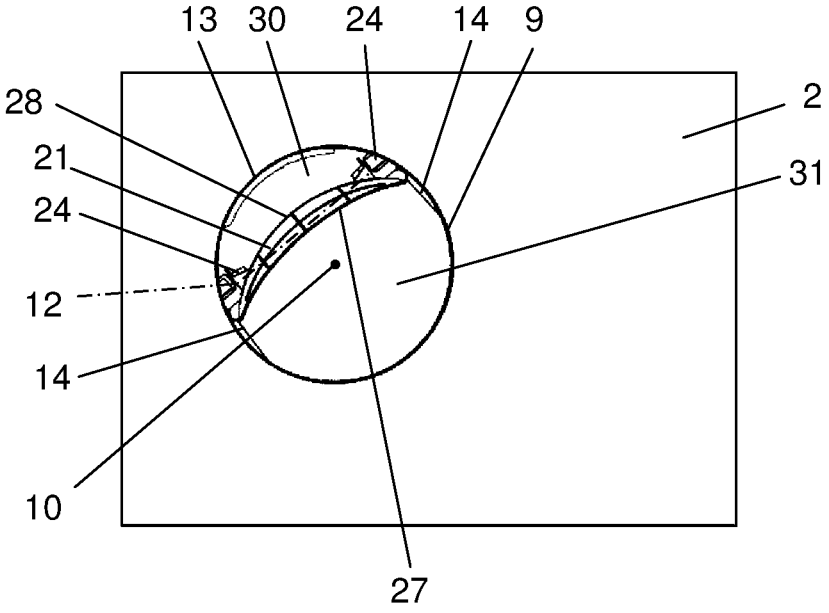
FIG. 1B is a front view showing the open state of the shutter structure in the exemplary embodiment of the present disclosure.

FIG. 1A is a schematic cross sectional view showing an open state of a shutter structure in the exemplary embodiment of the present disclosure. FIG. 1B is a front view showing the open state of the shutter structure in the exemplary embodiment of the present disclosure. As shown in FIG. 1A, blower module 1 includes casing 5 located inside outer casing 2 and having air inlet 3 and air outlet 4, blowing part 6, duct line 9, and shutter structure 20.

Blowing part 6, which is located inside casing 5, includes motor 7, and fan 8 connected to a motor shaft included in motor 7. The fan 8 is, for example, a sirocco fan allowed to keep static pressure high. Blower module 1 generates airflow 50 by using blowing part 6.

Duct line 9 includes rotary shaft 12 that pivotally supports shutter structure 20 thereinside. One end of duct line 9 is communicated with air outlet 4, and the other end is communicated with exhaust port 11. Rotary shaft 12, which does not intersect with duct line central axis 10, is disposed on a wall surface of duct line 9 that is located upper than duct line central axis 10. Further, a flow passage in duct line 9 is divided into upstream region 17 and downstream region 18 by a plane that is perpendicular to duct line central axis 10 and includes rotary shaft 12.

Shutter structure 20, which is described later in detail, includes shutter plate 21 having shutter plate shaft portion 24 whose axis coincides with rotary shaft 12.

Air inlet 3 is directed to, for example, indoor rooms such as a living room, and exhaust port 11 is directed to, for example, the outdoors. Note that, in the following description, an air outlet 4 side is defined as an upstream side, and an exhaust port 11 side is defined as a downstream side.

Shutter plate 21 is rotated about rotary shaft 12 and disposed to switch between open state 40 in which fluid flows in duct line 9 and closed state 41 in which duct line 9 is closed. Herein, in closed state 41 (see FIG. 2 A), a surface of shutter plate 21 on the exhaust port 11 side is defined as downstream side 28, and a surface of shutter plate 21 on the air outlet 4 side is defined as upstream side 27.

Further, when shutter plate 21 is in open state 40, in a cross section perpendicular to duct line central axis 10 of duct line 9, a flow passage located on a vertically upper side from rotary shaft 12, i.e., a flow passage between an inner wall of duct line 9 and downstream side 28 of shutter plate 21, is defined as upper flow passage 30, as shown in FIG. 1B.

Likewise, a flow passage located on a vertically lower side from rotary shaft 12, i.e., a flow passage between the inner wall of duct line 9 and upstream side 27 of shutter plate 21, is defined as lower flow passage 31. In other words, the flow passage in duct line 9 is divided into upper flow passage 30 and lower flow passage 31 by shutter plate 21 in open state 40.

Next, a configuration of shutter structure 20 will be described in detail with reference to FIGS. 2A and 2B.

Figure 2A:
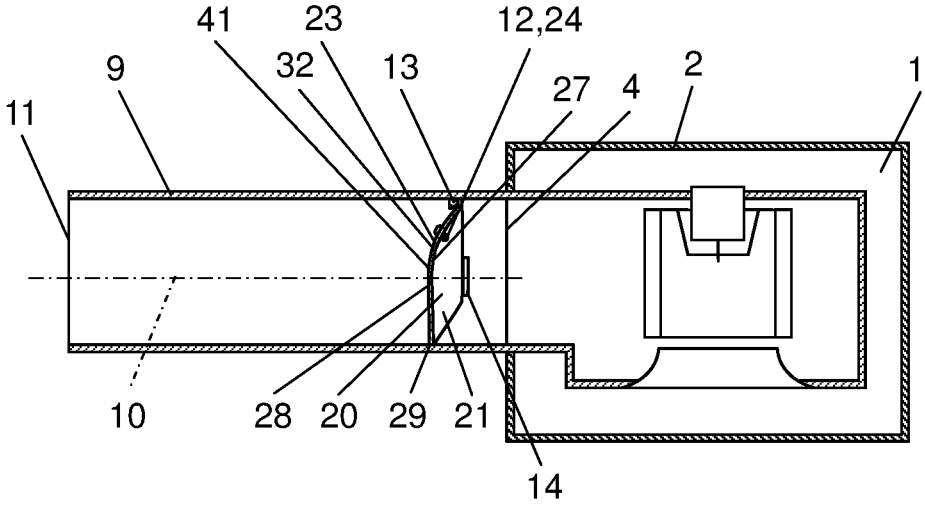
FIG. 2A is a schematic cross sectional view showing a closed state of the shutter structure in the exemplary embodiment of the present disclosure.

FIG. 2A is a schematic cross sectional view showing a closed state of the shutter structure in the exemplary embodiment. FIG. 2B is a front view showing the closed state of the shutter structure in the exemplary embodiment. As shown in FIGS. 2A and 2B, shutter structure 20 includes shutter plate 21 as mentioned above. Shutter plate 21 includes peripheral edge portion 22, curved portion 23, and shutter plate shaft portion 24. Peripheral edge portion 22 is included in a cross section perpendicular to duct line central axis 10 when shutter plate 21 is in closed state 41. In curved portion 23, center portion 32 and downstream side end 29, which serves as a tip end portion, of shutter plate 21 are bulged toward exhaust port 11, which is located on the downstream side, relative to peripheral edge portion 22 when shutter plate 21 is in closed state 41. Shutter plate shaft portion 24 is placed in curved portion 23. Shutter plate shaft portion 24 pivotally supports shutter plate 21 such that an axis of shutter plate shaft portion 24 coincides with rotary shaft 12.

Figure 2B:
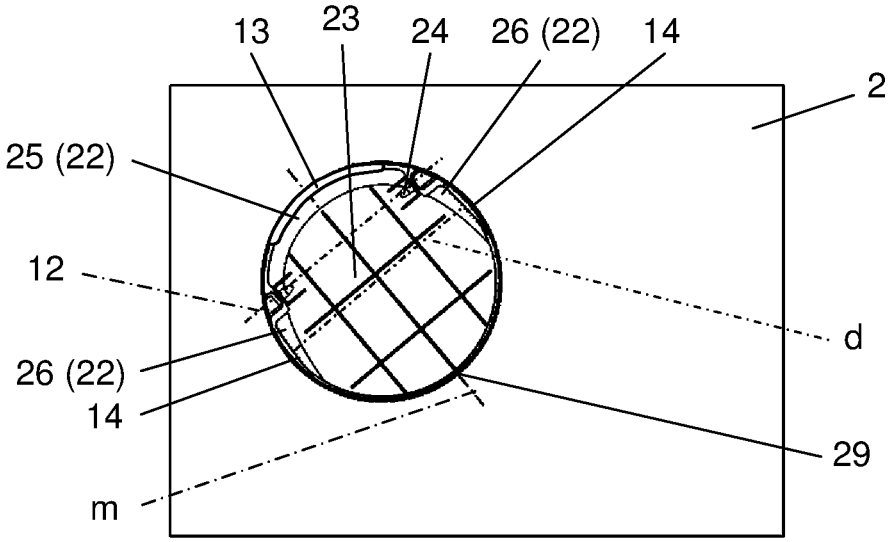
FIG. 2B is a front view showing the closed state of the shutter structure in the exemplary embodiment of the present disclosure.

The peripheral edge portion 22 includes upper shielding plate 25 and lower shielding plates 26, as shown in FIG. 2B. Upper shielding plate 25 is provided above shutter plate shaft portion 24. Two lower shielding plates 26 are provided below shutter plate shaft portion 24. Two lower shielding plates 26 are placed at positions symmetrical to each other with respect to center line m intersecting with shutter plate shaft portion 24 of shutter plate 21 perpendicularly. Upper shielding plate 25 is placed on center line m.

Further, as shown in FIG. 2A, in duct line 9, upper rib 13 and lower rib 14 are disposed on the upstream side from rotary shaft 12, i.e., between rotary shaft 12 and air outlet 4 in a direction of duct line central axis 10. Upper rib 13 is disposed to be in contact with downstream side 28 of upper shielding plate 25 when shutter plate 21 is in closed state 41. Further, lower rib 14 is disposed to be in contact with upstream side 27 of lower shielding plate 26 when shutter plate 21 is in closed state 41. Thus, when the shutter plate is in the closed state, the upper shielding plate and the two lower shielding plates are also located on the upstream side from the rotary shaft.

In the above configuration, an operation of shutter structure 20 will be described in detail with reference to FIG. 3.

First, the operation of shutter structure 20 when blower module 1 is activated will be described.

Figure 3:
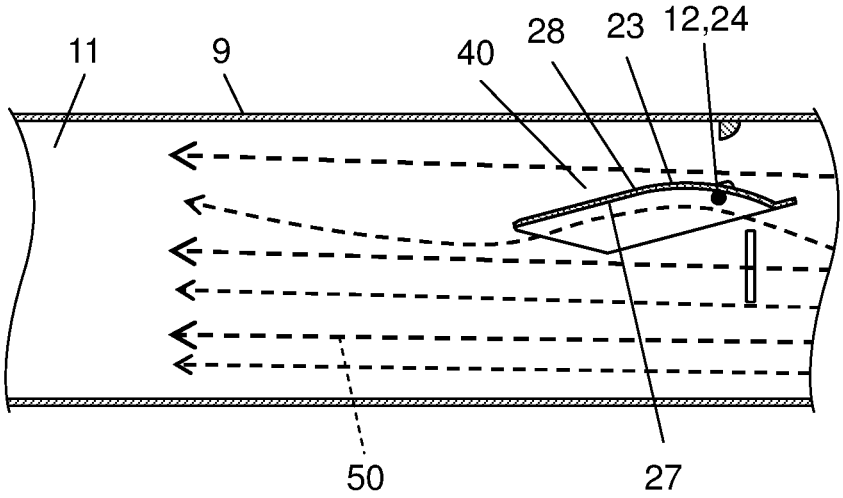
FIG. 3 is a view showing airflow in the open state of the shutter structure in the exemplary embodiment of the present disclosure.

FIG. 3 is a view showing airflow when the shutter structure of the exemplary embodiment is in the open state. When motor 7 of blowing part 6 is driven, fan 8 connected to a motor shaft of motor 7 is rotated, and then blower module 1 generates airflow 50.

In other words, as fan 8 is rotated, air (fluid) is sucked into casing 5 from air inlet 3. Static pressure of the sucked air is raised in casing 5, and the sucked air is induced into duct line 9 through air outlet 4 as airflow 50 and discharged from exhaust port 11 through shutter structure 20.

Thus, blower module 1 is allowed to discharge the air containing bad smell or the like, which occurs indoors, to the outdoors.

In this way, when blower module 1 is activated to generate airflow 50, i.e., when airflow 50 flows from air outlet 4 of duct line 9 toward exhaust port 11, shutter structure 20 is in open state 40. At this time, airflow 50 is received by the entirety of upstream side surface 27 of shutter plate 21 to rotate shutter plate 21 about rotary shaft 12. This makes it possible to maintain the attitude of shutter plate 21 stably at a position where self-weight of shutter plate 21 and the ventilation resistance, which is caused by airflow 50, are balanced.

In other words, when blower module 1 is operated normally, airflow 50 is received by upstream side surface 27 of shutter plate 21, so that shutter structure 20 is turned into open state 40, as shown in FIG. 3.

At this time, since shutter plate 21 is formed to have a smoothed cross-sectional shape including curved portion 23, airflow 50 is received by upstream side surface 27 and flows along curved portion 23, thereby preventing disturbance of airflow 50.

Further, as shown in FIG. 1B, upper rib 13 and lower ribs 14 are only disposed in duct line 9. In other words, upper rib 13 and lower rib 14 are disposed in only a part of the inner wall rather than over the entire inner wall of duct line 9. This makes it possible to miniaturize the ribs, i.e., upper rib 13 and lower rib 14 that are disposed in duct line 9 and brought into contact with peripheral edge portion 22 of shutter plate 21 can be decreased in size. Accordingly, shutter plate 21 is pivotally opened along airflow 50, and upper rib 13 and lower rib 14 are made small enough not to cause ventilation resistance. This makes it possible to reduce the ventilation resistance of shutter structure 20.

Next, an operation of shutter plate 21 when blower module 1 is stopped will be described.

Figure 4A:
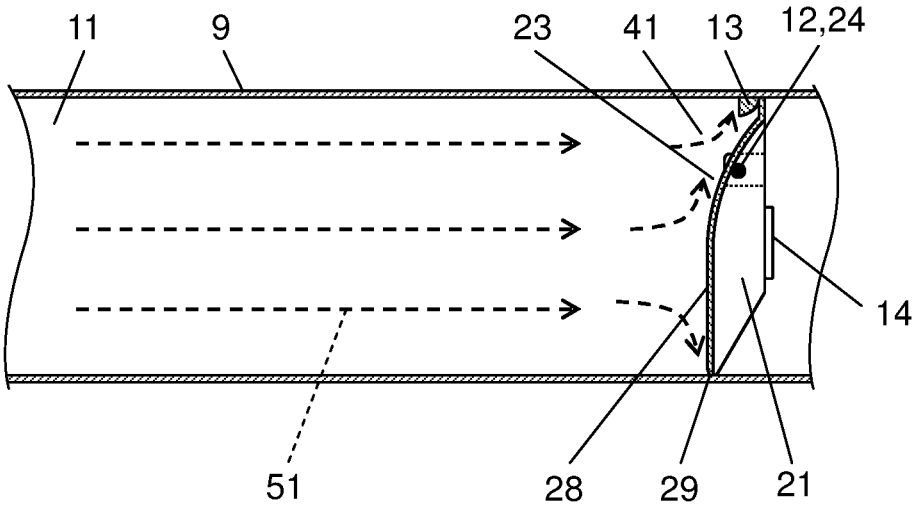
FIG. 4A is a schematic cross sectional view showing reverse airflow in the closed state of the shutter structure in the exemplary embodiment of the present disclosure.
Figure 4B:
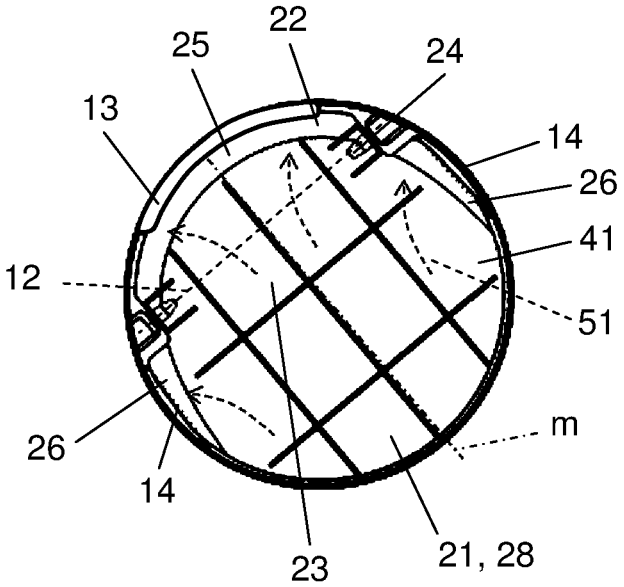
FIG. 4B is a front view showing the reverse airflow in the closed state of the shutter structure in the exemplary embodiment of the present disclosure.

FIG. 4A is a schematic cross sectional view showing reverse airflow in the closed state of the shutter structure in the exemplary embodiment. FIG. 4B is a front view showing the reverse airflow in the closed state of the shutter structure in the exemplary embodiment. Shutter structure 20 plays the role that prevents airflow 51 from reversely flowing into blower module 1 from the outdoors. When blower module 1 is operated normally, shutter structure 20 is turned into open state 40. At this time, it is preferred that blower module 1 does not impede airflow 50. Further, when blower module 1 is stopped or when outdoor air causes reverse airflow 51 by flowing into the inside from exhaust port 11 or the like, shutter structure 20 is turned into closed state 41. At this time, reverse airflow 51 is preferably prevented from flowing into blower module 1 or an indoor side.

As shown in FIGS. 2A and 2B, when blower module 1 is stopped, i.e., if airflow 50 is not generated, shutter structure 20 will be in closed state 41. At this time, shutter plate 21 is rotated about rotary shaft 12 by its own weight, and can maintain its attitude stably at a position where downstream side end 29 of shutter plate 21 is directed vertically downward.

For instance, when blower module 1 is stopped, external wind may flow into the inside from the outdoors through exhaust port 11 due to bad weather or the like and cause reverse airflow 51, as shown in FIG. 4A.

In such a case, reverse airflow 51 is received by the entirety of downstream side surface 28 of shutter plate 21, as shown in FIG. 4B. Thus, reverse airflow 51 flows along downstream side surface 28. Further, shutter plate 21 receives the force that rotates shutter plate 21 about rotary shaft 12, and thus upper shielding plate 25 and upper rib 13 come into contact with each other, and lower shielding plate 26 and lower rib 14 come into contact with each other.

Consequently, shutter plate 21 is fixed and its position is maintained in closed state 41. Further, shutter plate 21 can guide reverse airflow 51 to upper shielding plate 25 and two lower shielding plates 26 along downstream side surface 28 by using the shape of curved portion 23. Accordingly, reverse airflow 51 is interrupted by upper shielding plate 25 and upper rib 13, and two lower shielding plates 26 and lower ribs 14. In other words, reverse airflow 51 is prevented from flowing into the inside of blower module 1 and an indoor side through a gap between shutter plate 21 and duct line 9.

Note that, shutter plate 21 is preferably curved symmetrically to center line m. Further, it is preferred that lower shielding plates 26 are formed to face each other on diameter d (shown in FIG. 2B) of duct line 9 parallel to rotary shaft 12.

Accordingly, even if reverse airflow 51 flows into duct line 9 from the downstream side to the upstream side in closed state 41, reverse airflow 51 can be received by the entirety of downstream side surface 28 of shutter plate 21, which is curved symmetrically to center line m. Upper shielding plate 25 comes into contact with upper rib 13 from the upstream side in duct line 9, and lower shielding plates 26 come into contact with lower ribs 14 from the downstream side in duct line 9. Thus, shutter plate 21 can maintain closed state 41.

Further, at this time, reverse airflow 51 flows toward upper shielding plate 25 and two lower shielding plates 26 along downstream side surface 28 of shutter plate 21, thereby ensuring the contact of upper shielding plate 25 and upper rib 13, and the contact of lower shielding portions 26 and lower ribs 14. Further, upper shielding plate 25 and upper rib 13, and two lower shielding plates 26 and lower ribs 14 can prevent reverse airflow 51 from flowing into the inside thorough a gap between shutter plate 21 and duct line 9. Accordingly, reverse airflow 51 can be prevented from flowing into blower module 1 or an indoor room.

Figure 5:
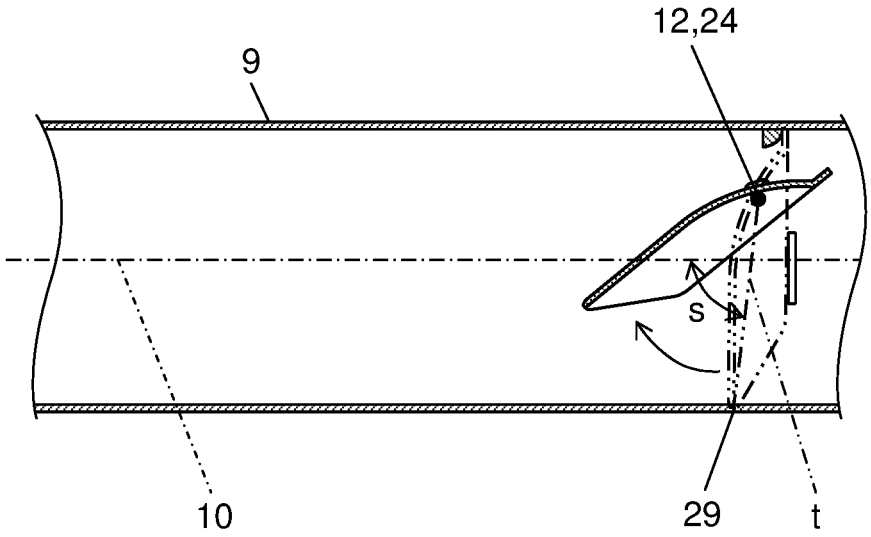
FIG. 5 is a schematic cross sectional view showing a process on the way to the open state from the closed state of the shutter structure in the exemplary embodiment of the present disclosure.

FIG. 5 is a schematic cross sectional view showing a process on the way to the open state from the closed state of the shutter structure in the exemplary embodiment. As shown in FIG. 5, when shutter plate is in closed state 41, it is preferred that angle s, which is located on a duct line central axis 10 side, has an acute angle among angles between duct line central axis 10 and axis t connecting rotary shaft 12 and downstream side end 29 of shutter plate 21. In other words, in the cross section including duct line central axis 10, downstream side end 29 is preferably located on the downstream side from the plane that is perpendicular to duct line central axis 10 and includes rotary shaft 12.

At the time when blower module 1 is changed from an idle state to a normal operation state, airflow 50 is caused. As airflow 50 is caused, shutter structure 20 is changed from closed state 41 to open state 40. The above configuration makes it possible to form a gap between outer periphery of shutter plate 21 and an inner wall of duct line 9 even if shutter plate 21 is rotated at a small angle. Accordingly, when airflow 50 is caused by blower module 1, shutter plate 21 can form a gap between outer periphery of shutter plate 21 and an inner wall of duct line 9 by small angle rotation of shutter plate 21. When a gap is formed between the outer periphery of shutter plate 21 and the inner wall of duct line 9, airflow 50 flows along upstream side surface 27. Accordingly, airflow 50 is promoted to flow and gather at downstream side end 29, so that shutter plate 21 is smoothly changed to open state 40 from closed state 41. This makes it easy to open and close shutter plate 21.

Especially, even when a small amount of airflow 50 flows in duct line 9 and shutter plate 21 is rotated at a small angle, shutter plate 21 can easily be changed to open state 40. Accordingly, a load applied to motor 7 or fan 8 can be reduced. Further, shutter plate 21 can easily be balanced by a small amount of flow. Accordingly, the ventilation resistance of shutter structure 20 can be made smaller.

In this way, shutter structure 20 of the exemplary embodiment can advantageously provide a blower module with a shutter structure that has small ventilation resistance when blower module 1 is operated normally, and can prevent inflow of reverse airflow 51 more effectively, even if reverse airflow 51 occurs, when blower module 1 is stopped.

Note that, curved portion 23 is preferably accommodated on an upper flow passage 30 side of shutter plate 21 located above duct line central axis 10. This is because large curved portion 23 enlarges shutter plate 21 in size and impedes reduction in ventilation resistance.

Note that, rotary shaft 12 is preferably inclined at a predetermined angle rather than horizontal, as shown in FIG. 1B. This is because, if the inclination of rotary shaft 12 approaches vertical, a vertical component of self-weight of shutter plate 21, which balances with airflow 50, is reduced, thereby making ventilation resistance smaller. However, to change shutter plate 21 to closed state 41 automatically when airflow 50 is stopped, self-weight of shutter plate 21 needs to act vertically downward regardless of installation conditions of blower module 1 so that shutter plate 21 is rotated about rotary shaft 12 and turned into closed state 41. Accordingly, it is preferred that the inclination of rotary shaft 12 is set to be neither perfectly vertical nor horizontal.

Note that, shutter plate 21 is preferably made of resin such as PP (Polypropylene) and ABS (Acrylonitrile Butadiene Styrene), because the resin can be formed into any shape and a shape change over the years may be small.

The shutter structure in accordance with the present disclosure can reduce ventilation resistance in an open state, thereby achieving a small motor load and power saving, and can also prevent inflow of an external wind in a closed state. Accordingly, the shutter structure is useful for preventing fluid, which is mainly generated by a ventilating device, a pump, or the like, from reversely flowing into a duct line.

What is claimed is:

1. A shutter structure comprising:

a rotary shaft provided in a cylindrical duct line through which fluid flows from an upstream side to a downstream side;

a shutter plate that is rotated about the rotary shaft and disposed to switch between an open state in which the fluid flows into the duct line and a closed state in which the duct line is closed; and an upper rib and at least two lower ribs that are disposed on the upstream side from the rotary shaft separately provided on an inner wall of the duct line, wherein in the closed state, the shutter plate has:

a peripheral edge portion including an upper shielding plate and two lower shielding plates, the peripheral edge portion being provided on a cross section perpendicular to a central axis of the duct line;

a curved portion in which a center portion and a downstream side end of the shutter plate are bulged to the downstream side relative to the peripheral edge portion; and a shutter plate shaft portion that is located in the curved portion and pivotally supported by the rotary shaft, wherein:

the two lower shielding plates are located on the shutter plate at positions symmetrical to each other with respect to a center line intersecting with the shutter plate shaft portion perpendicularly, and the upper shielding plate is located on the center line;

when the shutter plate is in the closed state, the upper shielding plate and the two lower shielding plates are located on the upstream side from the rotary shaft, when the shutter plate is in the closed state, the upper shielding plate comes into contact with the upper rib from the upstream side, and the two lower shielding plates come into contact with the at least two lower ribs from the downstream side, when the shutter plate is in the closed state, reverse airflow which flows from the downstream side to the upstream side is guided to the upper shielding plate and the two lower shielding plates by the curved portion, the upper shielding plate and the two lower shielding plates are disposed on the upstream side from the rotary shaft, and when the shutter plate is in the closed state, the reverse airflow is interrupted by the upper shielding plate and the upper rib, and the two lower shielding plates and the at least two lower ribs, the upper shielding plate and the upper rib, and the two lower shielding plates and the at least two lower ribs are provided on the cross section.

2. The shutter structure according to claim 1, wherein a flow passage in the duct line is divided into an upstream region and a downstream region by a plane that is perpendicular to the central axis and includes the rotary shaft, and the curved portion is formed to be curved at least partially ranging from the upstream region to the downstream region along the central axis.

3. The shutter structure according to claim 1, wherein the shutter plate is formed to be curved symmetrically to the center line.

4. The shutter structure according to claim 1, wherein the two lower shielding plates are formed to face each other on a diameter of the duct line parallel to the rotary shaft, when the shutter plate is in the closed state.

5. The shutter structure according to claim 1, wherein in a cross section including the central axis, the downstream side end is located on the downstream side from a plane that is perpendicular to the central axis and includes the rotary shaft.

6. The shutter structure according to claim 1, wherein the rotary shaft is inclined at a predetermined angle relative to a horizontal plane.

* * * * *